US010271644B1

(12) United States Patent
Johnson

(10) Patent No.: US 10,271,644 B1
(45) Date of Patent: Apr. 30, 2019

(54) SUPPORT ROD STORAGE SECURING SYSTEM

(71) Applicant: Barbara Johnson, Plymouth, MN (US)

(72) Inventor: Barbara Johnson, Plymouth, MN (US)

( * ) Notice: Subject to any disclaimer, the term of this patent is extended or adjusted under 35 U.S.C. 154(b) by 0 days.

(21) Appl. No.: 15/923,181

(22) Filed: Mar. 16, 2018

(51) Int. Cl.

| | |
|---|---|
| ***A45C 5/04*** | (2006.01) |
| ***A45C 13/03*** | (2006.01) |
| ***A47B 61/02*** | (2006.01) |
| ***A47B 61/06*** | (2006.01) |
| ***A47G 25/06*** | (2006.01) |

(52) U.S. Cl.
CPC ..... *A47B 61/06* (2013.01); *A45C 5/04* (2013.01); *A45C 13/03* (2013.01); *A47B 61/02* (2013.01); *A47G 25/0657* (2013.01); *A47G 25/0692* (2013.01)

(58) Field of Classification Search
CPC ..... A47B 61/06; A47B 61/02; A47B 61/003; A47B 61/04; A45C 5/04; A45C 9/00; A45C 2200/15; A45C 2009/007; A45C 13/03; A45C 5/00; D06F 57/00; D06F 57/02; D06F 57/08; D06F 57/127; A47G 25/0685; A47G 25/0657; A47G 25/0664; A47G 25/0692; A47F 5/0006; F16B 45/00
USPC ..... 211/2, 204, 206, 85.3, 1.3, 85.24, 105.1, 211/123, 124, 119.004, 119.009; 190/13 R, 15 R, 1; 383/4; 206/289; 248/301, 304; D8/367
See application file for complete search history.

(56) References Cited

U.S. PATENT DOCUMENTS

| | | | | | |
|---|---|---|---|---|---|
| 792,793 | A * | 6/1905 | Richmond | A45C 9/00 | 190/16 |
| 815,060 | A * | 3/1906 | Beebe | A47K 10/04 | 211/123 |
| 915,507 | A * | 3/1909 | Thomas | A47B 61/06 | 190/13 B |
| 930,343 | A * | 8/1909 | Bonsall | A45C 13/03 | 190/14 |
| 1,104,180 | A * | 7/1914 | Forlong | A47K 10/04 | 211/123 |
| 1,510,294 | A * | 9/1924 | Bertrand | A47G 25/06 | 211/123 |
| 1,520,044 | A * | 12/1924 | Wilt | A45C 5/04 | 190/13 R |
| 1,696,128 | A * | 12/1928 | Shee | A47C 7/64 | 16/15 |
| 1,894,485 | A * | 1/1933 | Frankl | A45C 13/03 | 190/13 H |
| 1,919,083 | A * | 7/1933 | Wheary | A45C 13/03 | 206/292 |

(Continued)

*Primary Examiner* — Jennifer E. Novosad

(57) ABSTRACT

A support rod storage securing system includes a container for holding clothing that has a bottom wall and a perimeter wall that is attached to and extending upwardly from the bottom wall. The perimeter wall has an upper edge defining an opening extending into the container. A frame member is mounted to the container. A collapsible dressing station is removably mountable to the container such that the collapsible dressing station extends upwardly from the container. The collapsible dressing station includes an upper bar configured to receive clothes hangers. A pair of connectors each is attached to the frame member. The upper bar is removably mounted on the pair of connectors such that the upper bar is releasably retained in a static position within the container.

7 Claims, 3 Drawing Sheets

(56) References Cited

U.S. PATENT DOCUMENTS 1,966,283 A * 7/1934 Brody ..... A47B 61/02 211/106
2,016,688 A * 10/1935 Stelljes ..... A45C 13/03 206/298
2,091,931 A * 8/1937 Levine ..... A45C 13/03 206/278
2,126,986 A * 8/1938 Burger ..... A45C 13/03 206/292
2,271,784 A * 2/1942 Tritt ..... A47B 96/061 211/123
2,297,903 A * 10/1942 Levine ..... A45C 13/03 206/298
2,301,549 A * 11/1942 Koch ..... A45C 13/03 206/278
2,476,932 A * 7/1949 Tucker ..... A45C 13/03 190/15 R
2,480,327 A * 8/1949 Idelsohn ..... A47G 25/32 211/113
2,518,603 A * 8/1950 De Leonardis ..... A45C 13/03 206/298
2,633,998 A * 4/1953 Derman ..... A47G 25/08 108/135
2,639,793 A * 5/1953 Hellman ..... G09F 5/02 190/13 R
2,681,128 A * 6/1954 Staffa ..... A45C 13/03 190/13 R
2,796,961 A * 6/1957 Koch ..... A45C 13/03 206/289
3,141,535 A * 7/1964 Hamilton ..... A45C 13/03 190/13 R
3,187,904 A * 6/1965 Kiechle ..... A47G 25/1457 211/118
3,456,807 A * 7/1969 Amato ..... A47K 10/04 211/105.1
4,267,905 A * 5/1981 Stewart ..... A45C 13/02 190/13 R
4,308,962 A * 1/1982 Fahmi ..... A47G 25/1457 211/118
4,762,238 A * 8/1988 Blanchard ..... A47G 25/0692 211/123
4,925,021 A * 5/1990 Pulichino, Jr. ..... A45C 3/001 190/109
4,982,820 A * 1/1991 Scott ..... A45C 9/00 190/13 R
D354,412 S * 1/1995 Emery ..... D6/514
5,398,807 A * 3/1995 Plath ..... A45C 5/14 190/109
6,050,663 A * 4/2000 Schoellmann ..... A47B 45/00 312/408
6,269,922 B1 * 8/2001 Gosse ..... A45C 3/00 190/107
D494,454 S * 8/2004 Klein ..... D8/373
6,966,450 B2 * 11/2005 Askew ..... B65D 25/06 220/529
6,969,132 B1 * 11/2005 Viville ..... A47B 31/02 211/1.3
7,237,687 B1 * 7/2007 Abdi ..... A47G 25/0685 211/119.004
7,252,274 B1 * 8/2007 Brannen ..... A47J 45/02 248/301
7,607,535 B2 * 10/2009 Jackson ..... A45C 9/00 190/112
7,789,359 B2 * 9/2010 Chopp, Jr. ..... H02G 3/263 182/129
D657,054 S * 4/2012 Bacon ..... D24/128
9,084,460 B2 * 7/2015 Richards ..... A45C 7/0031
9,211,023 B1 * 12/2015 Weiss ..... A47G 25/0614
9,622,597 B2 * 4/2017 White ..... A47F 7/24
9,820,542 B2 * 11/2017 McKelvey ..... A45C 9/00
9,877,557 B2 * 1/2018 Collins ..... A45C 5/14
9,913,697 B1 * 3/2018 DeVeaux ..... A61B 50/30
2005/0145458 A1 * 7/2005 Cohen ..... A45C 5/065 190/18 A
2005/0211581 A1 * 9/2005 King ..... A45C 13/03 206/288
2007/0089952 A1 * 4/2007 Herbst ..... A45C 5/14 190/8
2007/0295570 A1 * 12/2007 Campbell ..... A45C 5/14 190/15 R
2008/0179370 A1 * 7/2008 Williams ..... A45C 13/02 224/682
2009/0000894 A1 * 1/2009 Middup ..... A45C 5/14 190/15 R
2009/0321204 A1 * 12/2009 Barkow ..... A45C 13/02 190/8
2010/0219312 A1 * 9/2010 Johnson ..... A45F 5/02 248/231.81
2010/0224747 A1 * 9/2010 Adams ..... A47G 25/0614 248/215
2010/0276241 A1 * 11/2010 Malone ..... A45C 5/03 190/9
2012/0061540 A1 * 3/2012 Platt ..... F16B 45/00 248/225.21
2012/0097628 A1 * 4/2012 Blacknell ..... A47B 45/00 211/85.3
2014/0262659 A1 * 9/2014 Hirsch ..... A47B 61/06 190/13 R
2015/0265016 A1 * 9/2015 Cavalheiro ..... A45C 9/00 190/15 R
2015/0306447 A1 * 10/2015 Neal-Buhler ..... A63B 21/16 248/231.81
2016/0213111 A1 * 7/2016 Aiello ..... A45C 9/00

* cited by examiner

SUPPORT ROD STORAGE SECURING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to storage devices and more particularly pertains to a new storage device for holding an upper support bar of a clothes supporting assembly when the upper support bar is not being used.

BRIEF SUMMARY OF THE INVENTION

An embodiment of the disclosure meets the needs presented above by generally comprising a container configured for holding clothing and including a bottom wall and a perimeter wall that is attached to and extends upwardly from the bottom wall. The perimeter wall has an upper edge defining an opening extending into the container. A frame member is mounted to the container. A collapsible dressing station is removably mountable to the container such that the collapsible dressing station extends upwardly from the container. The collapsible dressing station includes an upper bar configured to receive clothes hangers. A pair of connectors each is attached to the frame member. The upper bar is removably mounted on the pair of connectors such that the upper bar is releasably retained in a static position within the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
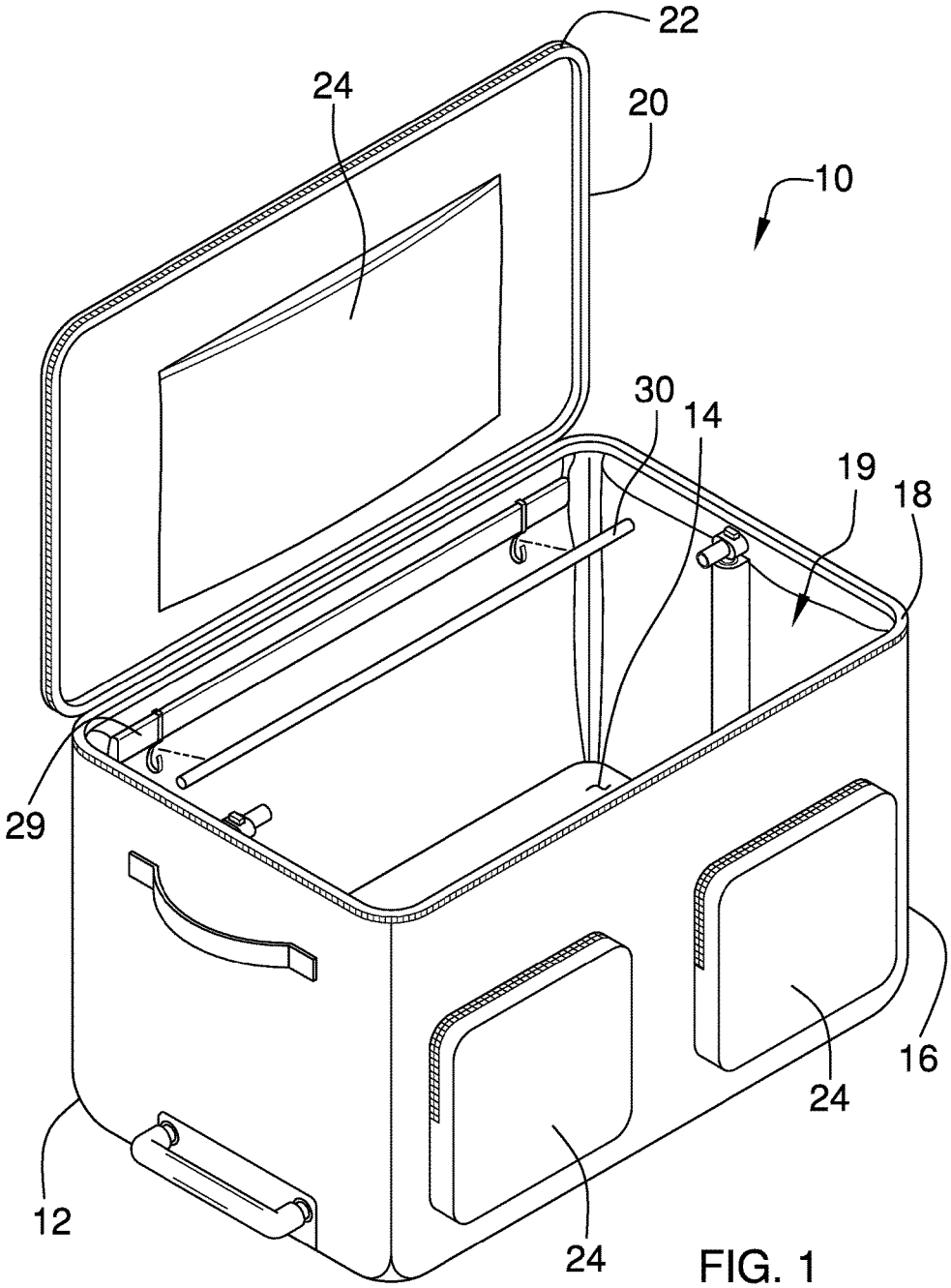
FIG. 1 is a front isometric in-use view of a support rod storage securing system according to an embodiment of the disclosure.
Figure 4:
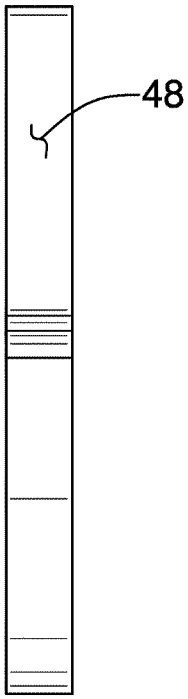
FIG. 4 is a side view of an embodiment of the disclosure.
Figure 3:
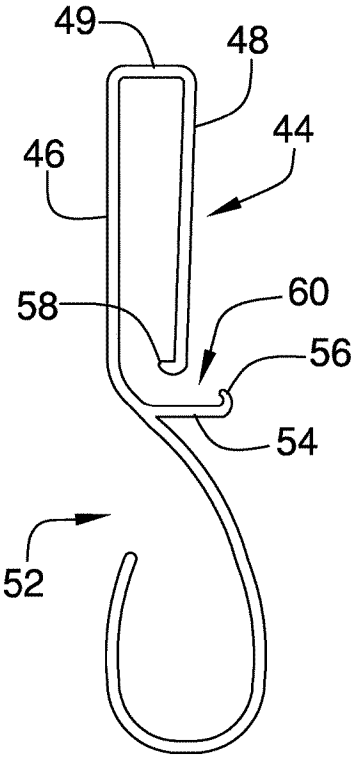
FIG. 3 is a rear isometric view of an embodiment of the disclosure.
Figure 2:
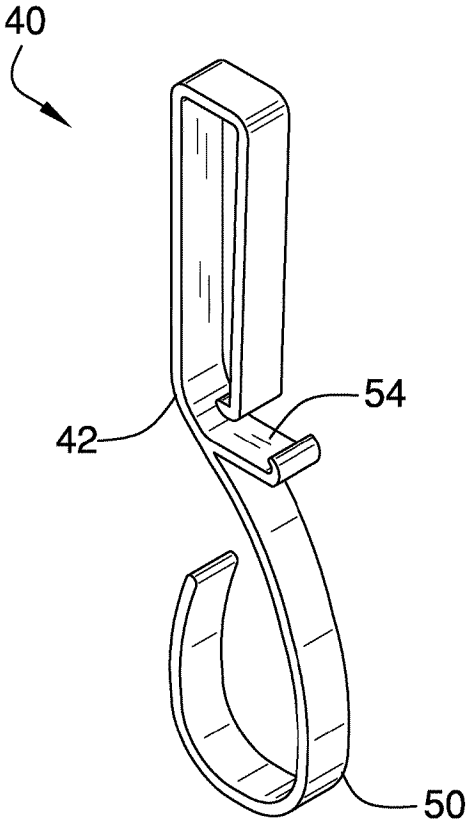
FIG. 2 is a front isometric in-use view of an embodiment of the disclosure.
Figure 5:
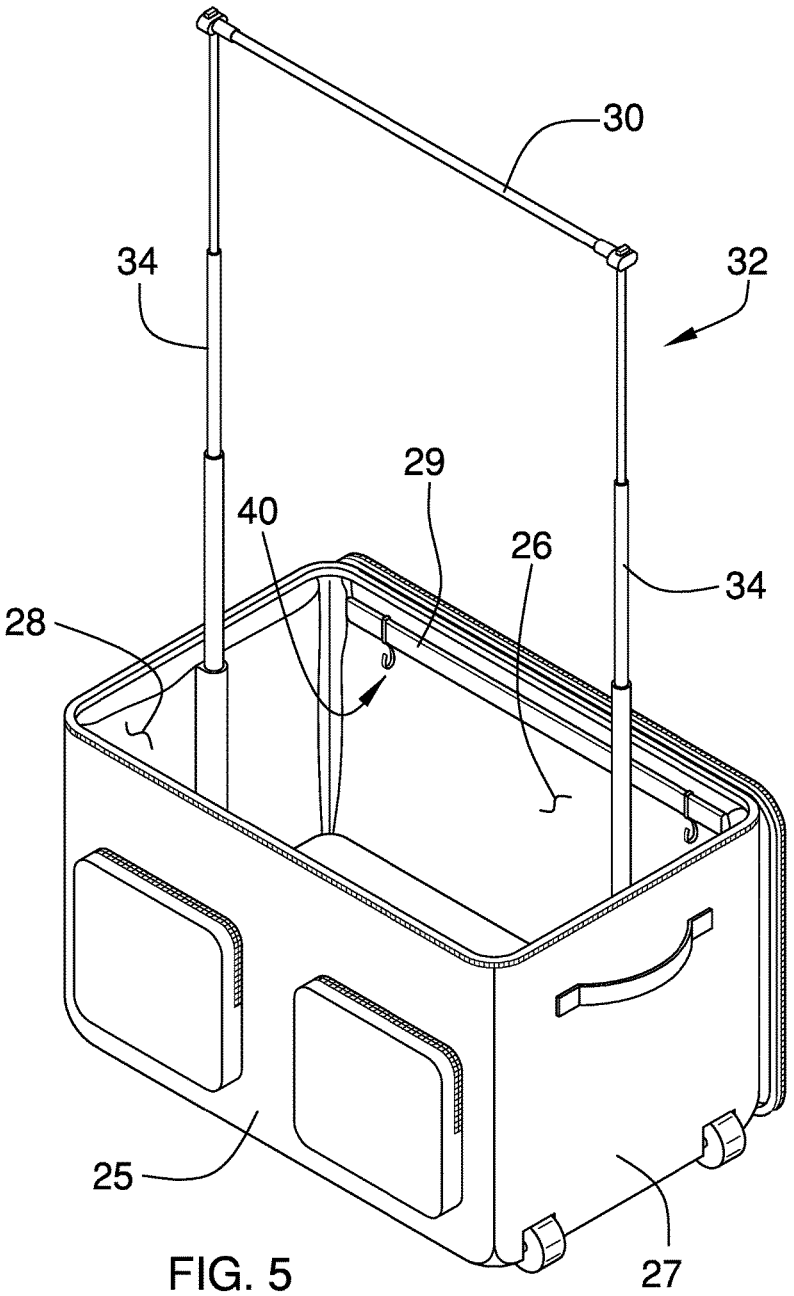
FIG. 5 is a rear view of an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the support rod storage securing system 10 generally comprises a securing structure used for storing an upper bar 30 of a dressing station 32 which is modular and storable within a carrying bag. An example of such a carrying bag and dressing station combination is found in U.S. patent application Ser. No. 12/494,658 filed on Jun. 30, 2009 and having a publication date of Dec. 31, 2009. Such a device includes a container 12 configured for holding clothing and the collapsible dressing station 32. The container 12 may typically include a duffle bag type luggage bag including a bottom wall 14 and a perimeter wall 16 attached to and extending upwardly from the bottom wall 14. The perimeter wall 16 has an upper edge 18 defining an opening 19 extending into the container 12. A cover 20 attached to the perimeter wall 16 is removably positionable in a closed position closing the opening 19. A zipper 22 may be provided for retaining the cover 20 in the closed position. Additional pockets 24 may be positioned on the container 12. The perimeter wall 16 includes a front wall 25, a rear wall 26, a first lateral wall 27 and a second lateral wall 28. A frame member 29, or stabilizer for retaining a shape of the container 12, is mounted to the container 12. The frame member 29 at least includes a portion that is positioned adjacent to the upper edge 18 on the rear wall 26 and extends between the first 27 and second 28 lateral walls. It should be understood that the description herein of the container 12 is exemplary only and all materials and constructions utilized with conventional luggage may be employed for the container 12.

The collapsible dressing station 32 is removably mountable to the container 12 such that the collapsible dressing station 32 extends upwardly from the container 12 when in use for supporting clothes. The collapsible dressing station 32 includes the upper bar 30 configured to receive clothes hangers (not shown) wherein the upper bar 30 is mounted on poles 34 that are attached to the container 12. The collapsible dressing station 32 may include other elements providing useful to a user of the system, such as, but not limited to, an attachable shroud to shield a person as the person stands adjacent to the collapsible dressing station 32 while changing clothes.

A pair of connectors 40 each is removably attached to the frame member 29. The upper bar 30 is removably mounted on the pair of connectors 40 such that the upper bar 40 is releasably retained in a static position within the container 12. This prevents the upper bar 30 from excess moving while in the container 12 so that the upper bar 30 is easily located when needed and not readily misplaced and lost. Each of the connectors 40 includes a clip portion 42 that has a rear side 44 releasably receiving and engaging the frame member 29. The clip portion 42 includes a first leg 46, a second leg 48 and a central member 49 that is attached to and extends between upper ends of the first 46 and second 48 legs. The frame member 29 is positionable between the first 46 and second 48 legs. A hook 50 is attached to the clip portion 42 and has a front side 52 releasably receiving and engaging the upper bar 30. The hook 50 is attached to and extends downwardly from the first leg 46.

More specifically, each connector 40 may further include a stop 54 that is attached to the first leg 46 and extends laterally away thereof. The stop 54 extends below the second leg 48. A flange 56 is attached to and extends upwardly from the stop 54. The flange 56 is positioned distal to the first leg 46. A lip 58 is attached to the second leg 48 distal to the central member 49 and extends toward the first leg 46. As can be appreciated from FIG. 3, the stop 54 and lip 58 help retain the clip portion 42 on the frame member 29 wherein the frame member 29 cannot easily move downwardly through a clip opening 60 positioned between the stop 54 and lip 58. The second leg 48 may be bent away from the first leg 46 to allow the clip portion opening 60 to be enlarged and the frame member 29 removed from the clip portion 42. The hook 50 may be arcuate as shown best in FIG. 3 and curve from the first leg 46, under and downwardly from the stop 54, and then upwardly back toward the first leg 46. The upper bar 30 will typically have a cylindrical shape so that the arcuately contoured hook 50 fits snuggly against the upper bar 30. However, the hook 50 may be shaped as needed, such as having a rectangular receiving space, if the upper bar 30 has a shape deviating from cylindrical.

In use, the connectors 40 are attached to the frame member 29 as described above and as shown in FIGS. 1 and 5. When the upper bar 30 is not being used, it is engaged with the hooks 50 to retain the upper bar 30 in a stored configuration above the bottom wall 14. This static storage location of the upper bar 30 ensures that the upper bar 30 will not be misplaced or move erratically within the container 12. Though the above teaches connectors 40 that are removable from the container 12, it is envisioned that the connectors 40 may be fixed to the container 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A support bar retention system comprising:

a container configured for holding clothing and including a bottom wall and a perimeter wall being attached to and extending upwardly from said bottom wall, said perimeter wall having an upper edge defining an opening extending into said container;

a frame member being mounted to said container;

a collapsible dressing station being removably mountable to said container such that said collapsible dressing station extends upwardly from said container, said collapsible dressing station including a removable upper bar configured to receive clothes hangers; and a pair of connectors each being attached to said frame member, said upper bar being removably mountable on said pair of connectors such that said upper bar is releasably retained in a storage position within said container, each of said connectors including a clip portion having a rear side releasably receiving and engaging said frame member, said clip portion including a first leg, a second leg and a central member being attached to and extending between upper ends of said first and second legs, said frame member being positionable between said first and second legs, and a hook attached to said clip portion and having a front side releasably receiving and engaging said upper bar in said storage position, said hook being attached to and extending downwardly from said first leg.

2. The support bar retention system according to claim 1, wherein said perimeter wall includes a front wall, a rear wall, a first lateral wall and a second lateral wall, said frame member being positioned on said rear wall and extending between said first and second lateral walls.

3. The support bar retention system according to claim 1, wherein each of said connectors further includes a stop being attached to said first leg and extending laterally away thereof, said stop extending below said second leg.

4. The support bar retention system according to claim 3, wherein each of said connectors further includes a flange being attached to and extending upwardly from said stop, said flange being positioned distal to said first leg.

5. The support bar retention system according to claim 3, wherein each of said connectors further includes a lip being attached to said second leg distal to said central member and extending toward said first leg.

6. The support bar retention system according to claim 1, wherein each of said connectors further includes a lip being attached to said second leg distal to said central member and extending toward said first leg.

7. A support bar retention system comprising:

a container configured for holding clothing and including a bottom wall and a perimeter wall being attached to and extending upwardly from said bottom wall, said perimeter wall having an upper edge defining an opening extending into said container, a cover being attached to said perimeter wall and being removably positionable in a closed position closing said opening, said perimeter wall including a front wall, a rear wall, a first lateral wall and a second lateral wall;

a frame member being mounted to said container, said frame member being positioned adjacent to said upper edge, said frame member being positioned on said rear wall and extending between said first and second lateral walls;

a collapsible dressing station being removably mountable to said container such that said collapsible dressing station extends upwardly from said container, said collapsible dressing station including a removable upper bar configured to receive clothes hangers;

a pair of connectors each being removably attached to said frame member, said upper bar being removably mountable on said pair of connectors such that said upper bar is releasably retained in a storage position within said container, each of said connectors including:

a clip portion having a rear side releasably receiving and engaging said frame member, said clip portion including a first leg, a second leg and a central member being attached to and extending between upper ends of said first and second legs, said frame member being positionable between said first and second legs;

a hook having a front side releasably receiving and engaging said upper bar in said storage position, said hook being attached to and extending downwardly from said first leg;

a stop being attached to said first leg and extending laterally away thereof, said stop extending below said second leg;

a flange being attached to and extending upwardly from said stop, said flange being positioned distal to said first leg; and a lip being attached to said second leg distal to said central member and extending toward said first leg.

* * * * *